US008801170B2

(12) United States Patent
Tombs et al.

(10) Patent No.: US 8,801,170 B2
(45) Date of Patent: Aug. 12, 2014

(54) PRODUCING A DEINKABLE PRINT

(75) Inventors: Thomas Nathaniel Tombs, Rochester, NY (US); Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 139 days.

(21) Appl. No.: 13/298,365

(22) Filed: Nov. 17, 2011

(65) Prior Publication Data

US 2013/0127964 A1 May 23, 2013

(51) Int. Cl.
*B41J 2/01* (2006.01)

(52) U.S. Cl.
USPC ..... 347/103

(58) Field of Classification Search
None
See application file for complete search history.

(56) References Cited

U.S. PATENT DOCUMENTS 5,021,804 A * 6/1991 Nozawa et al. ..... 347/176
5,581,290 A * 12/1996 Kuehnle ..... 347/115
5,751,299 A 5/1998 Denton et al.
5,849,066 A * 12/1998 Kellett ..... 106/31.13
6,276,792 B1 8/2001 Gundlach et al.
6,379,001 B1 * 4/2002 Tomida et al. ..... 347/100
6,677,973 B2 * 1/2004 Tajima et al. ..... 347/244
6,716,562 B2 4/2004 Uehara et al.
7,433,627 B2 * 10/2008 German et al. ..... 399/102
7,744,206 B2 * 6/2010 Carmody et al. ..... 347/100
7,883,200 B2 * 2/2011 Koga et al. ..... 347/100

FOREIGN PATENT DOCUMENTS

EP 1 226 975 7/2002
EP 1 227 136 7/2002

* cited by examiner

*Primary Examiner* — Laura Martin
*Assistant Examiner* — Jeremy Bishop
(74) *Attorney, Agent, or Firm* — Christopher J. White; Peyton C. Watkins

(57) ABSTRACT

A method of producing a deinkable print on an image-bearing member includes transferring a toner image onto the image-bearing member to form a continuous or discontinuous toner image layer, wherein toner in the toner image is soluble in a hydrophobic or oliophilic organic solvent. An ink image corresponding to the toner image is printed onto the toner image on the image-bearing member, the ink including colorant in a hydrophilic carrier fluid, so that the colorant is disposed over the toner image layer. The toner image and ink image are fixed to the receiver. The image-bearing member has an unprinted reflection density and has a deinked reflection density at most 0.15 above the unprinted reflection density.

5 Claims, 4 Drawing Sheets

PRODUCING A DEINKABLE PRINT

CROSS-REFERENCE TO RELATED APPLICATIONS

Reference is made to commonly assigned, U.S. patent application Ser. No. 13/298,358 filed Nov. 17, 2011, entitled "PRODUCING A DEINKABLE PRINT," by Tombs et al.; U.S. patent application Ser. No. 13/298,361 filed Nov. 17, 2011, entitled "DEINKABLE PRINT," by Tombs et al.; and U.S. patent application Ser. No. 13/298,368, filed Nov. 17, 2011, entitled "DEINKING A PRINT," by Tombs et al.; the disclosures of which are incorporated by reference herein.

FIELD OF THE INVENTION

This invention pertains to the field of printing and more particularly to producing deinkable printed matter.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants.

In order to recycle receivers that have been printed on, it is desirable to remove the colorant on the receiver. Removal processes are referred to as "deinking" processes. Deinking the receivers permits them to be recycled without having to bleach the color out of them. However, commonly-used inkjet printers deposit hydrophilic ink on absorbent papers. As the ink soaks into the paper after printing, the dyes or pigments in the inks become adhered to or embedded in the paper. These colorants are very difficult to remove. Specifically, solvents used in deinking processes are generally oliophilic, so are poor solvents for the hydrophilic or oliophobic inks generally used in inkjet printing. In an industrial recycling setting, therefore, deinking a mixed waste stream of inkjet- and toner-printed receivers sorting the printed receivers by printing technology and ink used before processing, increases the cost and complexity of recycling. Moreover, the chemicals for deinking hydrophilic inks would have to be processed, producing additional waste.

There is a need, therefore, for a way of providing inkjet prints that can be deinked and recycled.

SUMMARY OF THE INVENTION

According to an aspect of the present invention, there is provided a method of producing a deinkable print on an image-bearing member, comprising:

transferring a toner image onto the image-bearing member to form a continuous or discontinuous toner image layer, wherein toner in the toner image is soluble in a hydrophobic or oliophilic organic solvent;

printing an ink image corresponding to the toner image onto the toner image on the image-bearing member, the ink including colorant in a hydrophilic carrier fluid, so that the colorant is disposed over the toner image layer; and fixing the toner image and ink image to the image-bearing member;

wherein the image-bearing member has an unprinted reflection density and has a deinked reflection density at most 0.15 above the unprinted reflection density.

An advantage of this invention is that it provides a readily-deinkable and -recyclable print made using readily-available hydrophilic inks. The print can be deinked using conventional deinking solvents such as nonpolar organic solvents such as various alkanes and aromatic compounds such as pentane, hexane, octane, heptane, benzene, toluene, xylene, dichloromethane, trichloromethane, tetrachloromethane, 1,1 dichloroethane, 1,2 dichloroethane, 1,1,2 trichloroethane, and 1,1,1 trichloroethane. Colorant is retained mainly on the surface of the receiver and is mainly not absorbed into the receiver, permitting deinking without having to bleach the receiver. In various embodiments, deinkable materials are deposited only in the inked areas, and not in the noninked areas. This saves material compared to flood-coating a receiver with an ink-absorbent material. It also permits a viewer of the print to perceive the physical, textural, and visible attributes of the paper, which attributes a flood-coat would mask. Various embodiments permit the printer to produce prints with different perceived characteristics by, e.g., applying texture or gloss, applying an image-specific protective coating, or applying a UV or other fade-preventive overcoat. These effects and characteristics can be applied to the printed region without changing the characteristics of the paper in unprinted areas.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

The attached drawings are for purposes of illustration and are not necessarily to scale.

DETAILED DESCRIPTION OF THE INVENTION

Toner printing processes, such as electrophotographic (EP), electrostatographic, ionographic, and electrographic, and inkjet printing processes can be embodied in devices including printers, copiers, scanners, and facsimiles, and analog or digital devices, all of which are referred to herein as "printers."

Printers operate by depositing marking material (e.g., toner or ink) on a receiver (e.g., paper). In a multi-color printer, each color is referred to as a "component," and there is a different marking material for each color component. A printer typically includes a digital front-end processor (DFE), a marking engine (also referred to in the art as a "print engine") for applying marking material to the receiver, and one or more post-printing finishing system(s) (e.g. a UV coating system, a glosser, or a laminator). The DFE rasterizes input electronic files into image bitmaps for the marking engine to print, and permits operator control of the output. The marking engine takes the rasterized image bitmap from the DFE and renders the bitmap into a form that can control the printing process. The finishing system applies features such as protection, glossing, or binding to the prints. The printer can also include a color management system that captures the characteristics of the image printing process implemented in the marking engine (e.g. the electrophotographic process) to provide known, consistent color reproduction characteristics for various types of input (e.g. digital camera images or film images).

Multi-component (e.g., color) print images are typically made in a plurality of color imaging modules arranged in tandem, and the print images for each color component are successively transferred to a receiver moving through the modules. The receiver can be a web, or can be cut sheets held on a transport belt. Images for each color component can also be transferred to an intermediate, then transferred together to the receiver.

Some printers can deposit clear marking material (e.g., clear toner or transparent ink). As used herein, "clear" is considered to be a color of toner, as are cyan (C), magenta (M), yellow (Y), black (K), and light black (Lk), but the term "colored marking material" excludes clear marking material. Clear marking material can protect a print from fingerprints and reduce certain visual artifacts. Clear marking material can be similar to colored marking material, but without a colorant (e.g. dye or pigment) incorporated into the toner particles. Printers can also print tinted marking materials. These absorb less light than they transmit, but do contain colorants (e.g., pigments or dyes) that move the hue of light passing through them towards the hue of the tint.

Figure 1:
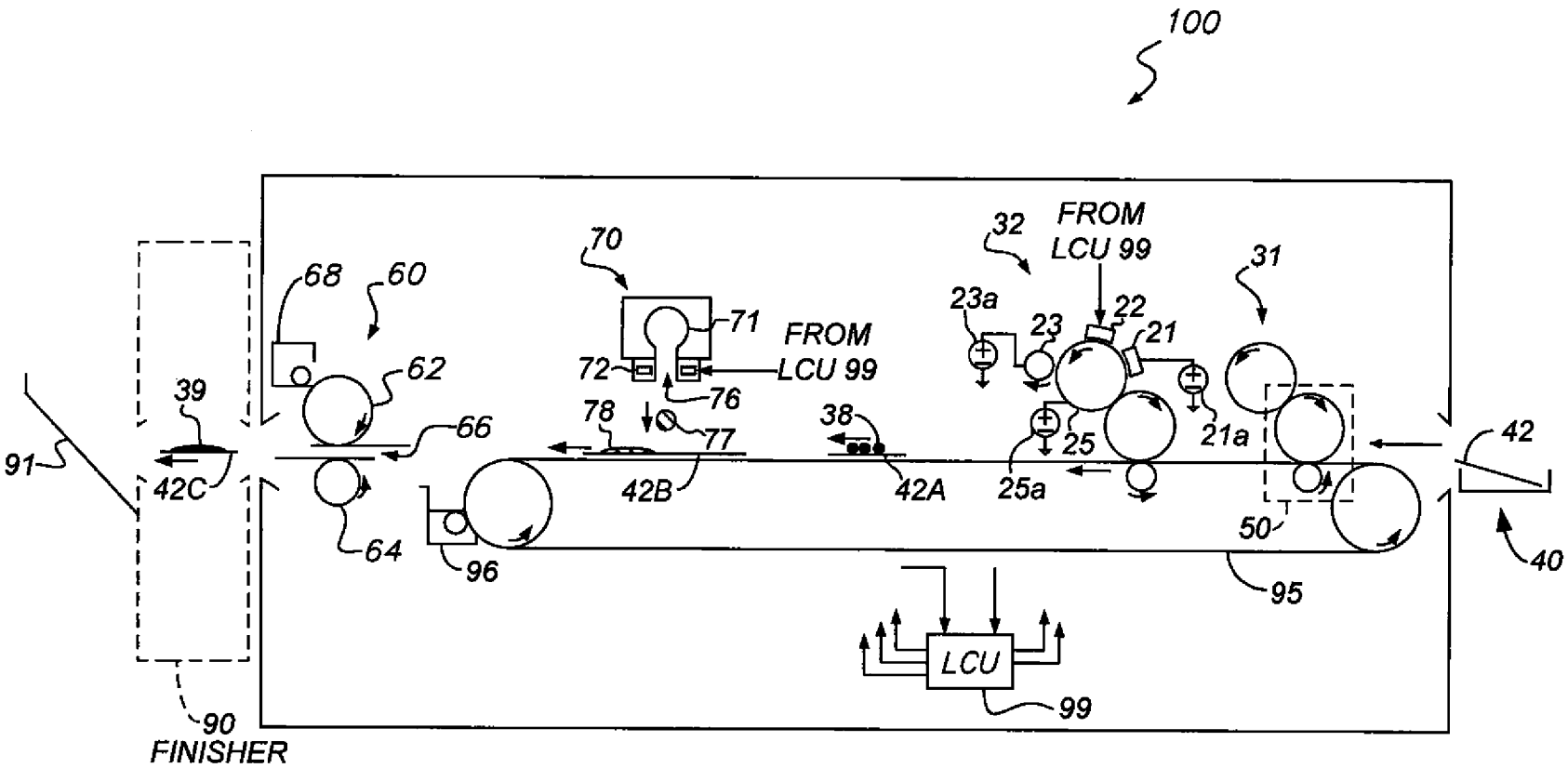
FIG. 1 is an elevational cross-section of a reproduction apparatus.

FIG. 1 is an elevational cross-section showing portions of a printer. Printer 100 produces print images having one or more color components, e.g., four or six components. Various components of printer 100 are shown as rollers; other configurations are also possible, including belts.

Printer 100 has one or more tandemly-arranged marking engines 31, 32, 70. Each marking engine 31, 32, 70 produces a print image for a single color component.

Marking engines 31 and 32 are EP marking engines. Each transfers its print image to receiver 42 using respective transfer subsystem 50 (for clarity, only one is labeled). Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each EP marking engine 31, 32 includes various components. For clarity, these are only shown in EP marking engine 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form the desired toner image 38, which includes unfused toner particles, on the receiver, as shown on receiver 42A. The imaging process is typically repeated many times with reusable photoreceptors 25.

Various parameters of the components of an EP marking engine (e.g., marking engines 31, 32) can be adjusted to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by logic and control unit (LCU) 99 to produce a latent image corresponding to the desired print image. All of these parameters can be changed.

Further details regarding EP marking engines 31, 32 and related components are provided in U.S. Pat. No. 6,608,641, issued on Aug. 19, 2003, to Peter S. Alexandrovich et al., in U.S. Publication No. 2006/0133870, published on Jun. 22, 2006, by Yee S. Ng et al., and U.S. patent application Ser. No. 12/942,420, filed Nov. 9, 2010, by Thomas N. Tombs et al., all of which are incorporated herein by reference.

Marking engine 70 is an inkjet marking engine. Inkjet marking engine 70 can include a drop-on-demand printhead, either thermal or piezoelectric, or a continuous printhead, using gas, electrostatic, or other deflection methods. The example shown in FIG. 1 is a thermal drop-on-demand marking engine.

Inkjet marking engine includes ink manifold 71 that contains liquid ink, either under pressure or not. Heater 72 is a resistive ring heater around nozzle 76 that heats ink in ink manifold 71 to its boiling point. The expansion in volume as the liquid boils into gas drives ink drop 77 out of nozzle 76 towards receiver 42B. A previously jetted ink drop is shown; it has spread out on receiver 42B to form ink image 78, as discussed below. Further details of inkjet marking engines are found in U.S. patent application Ser. No. 13/245,931, filed Sep. 27, 2011, U.S. Pat. Nos. 6,588,888, 4,636,808, and 6,851,796, all of which are incorporated herein by reference.

Piezoelectric drop-on-demand systems provide current to a piezoelectric actuator to cause it to deflect and push an ink drop out of ink manifold 71. Continuous-inkjet systems pressurize the ink in ink manifold 71 and break it into drops in a controlled manner, e.g., by selectively heating the ink stream in an appropriate timing sequence. In gas-deflection systems, two sizes of drops are produced, and an air flow not parallel with the direction of drop travel separates the two sizes of drops. Drops of one size strike the receiver; drops of the other size are caught and reused. Electrostatic-deflection systems charge drops to one of two charge states, and Lorentz forces between the drops and an electrode separate the two sizes of drops.

After toner image 38, ink image 78, or both are deposited on receiver 42, receiver 42B is subjected to heat or pressure to permanently fix ("fuse") toner image 38 to receiver 42A. Plural print images, e.g. of separations of different colors, are overlaid on one receiver before fusing to form a multi-color fused image 39 on receiver 42C.

Fuser 60, i.e., a fusing or fixing assembly, fuses toner image 38 to receiver 42A. Transport web 95 transports the toner-image-carrying receivers (e.g., 42A, 42B) to fuser 60, which fixes the toner particles to the respective receivers 42C by the application of heat and pressure. The receivers 42A are serially de-tacked from transport web 95 to permit them to feed cleanly into fuser 60. Transport web 95 is then reconditioned for reuse at cleaning station 96 by cleaning and neutralizing the charges on the opposed surfaces of the transport web 95.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed.

The receivers (e.g., receiver 42C) carrying the fused image (e.g., fused image 39) are transported from the fuser 60 along a path either to output tray 91, or back to marking engines 31, 32, 70 to create an image on the backside of the receiver (e.g., receiver 42C), i.e. to form a duplex print.

In various embodiments, between fuser 60 and output tray 91, receiver 42B passes through finisher 90. Finisher 90 performs various media-handling operations, such as folding, stapling, saddle-stitching, collating, and binding.

Printer 100 includes logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data.

Figure 2A:
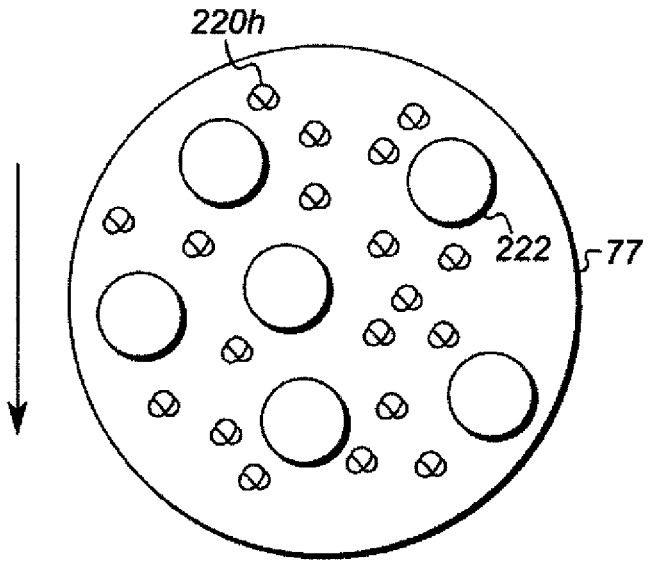
FIGS. 2A-2B show an interaction between ink and toner according to various embodiments.
Figure 2B:
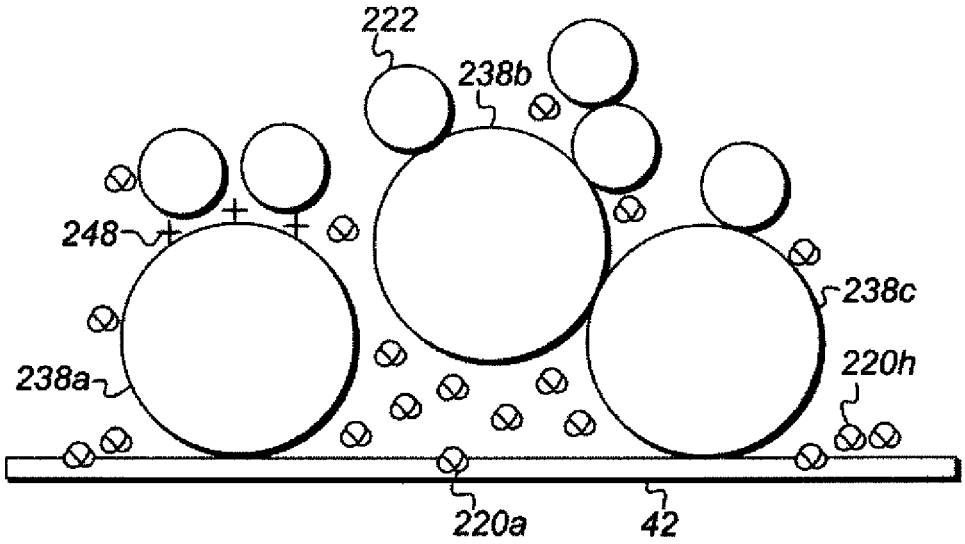

FIGS. 2A-2B show an interaction between ink and toner according to various embodiments. Referring to FIG. 2A, ink drop 77 travelling towards receiver 42 (FIG. 2B) includes water molecules 220*h*, represented graphically as space-filling models of $H_2O$ molecules. Ink drop 77 also includes colorant particles 222, e.g., pigment particles. Ink drop 77 can also include humectants, surfactants, or salts. These additives help stabilize the ink and reduce the probability of coagulation (agglomeration of suspended pigment particles).

FIG. 2B shows the situation after ink drop 77 has come into contact with receiver 42 bearing toner particles 238*a*, 238*b*, 238*c*. As shown, most of the water molecules (e.g., molecule 220*h*) have passed through gaps between toner particles 238*a*, 238*b*, 238*c*. In various embodiments, some, e.g., water molecule 220*a*, have begun to be absorbed into receiver 42. Colorant particles 222 are much larger than water molecules 220*h*, and some or all of the colorant particles rest on top of or become trapped within the matrix of toner particles 238*a*, 238*b*, 238*c*. As a result, colorant particles 222 remain substantially on top of toner particles 238*a*, 238*b*, 238*c* to form a visible image.

In some embodiments, toner particles (e.g., toner particle 238*a*, as shown here) include addenda (e.g., addendum 248) designed to encourage colorant particles 222 to come out of solution or suspension, i.e., to separate more rapidly or completely from water molecules 220*h*. Addendum 248 can be a salt, e.g., NaCl.

Figure 3:
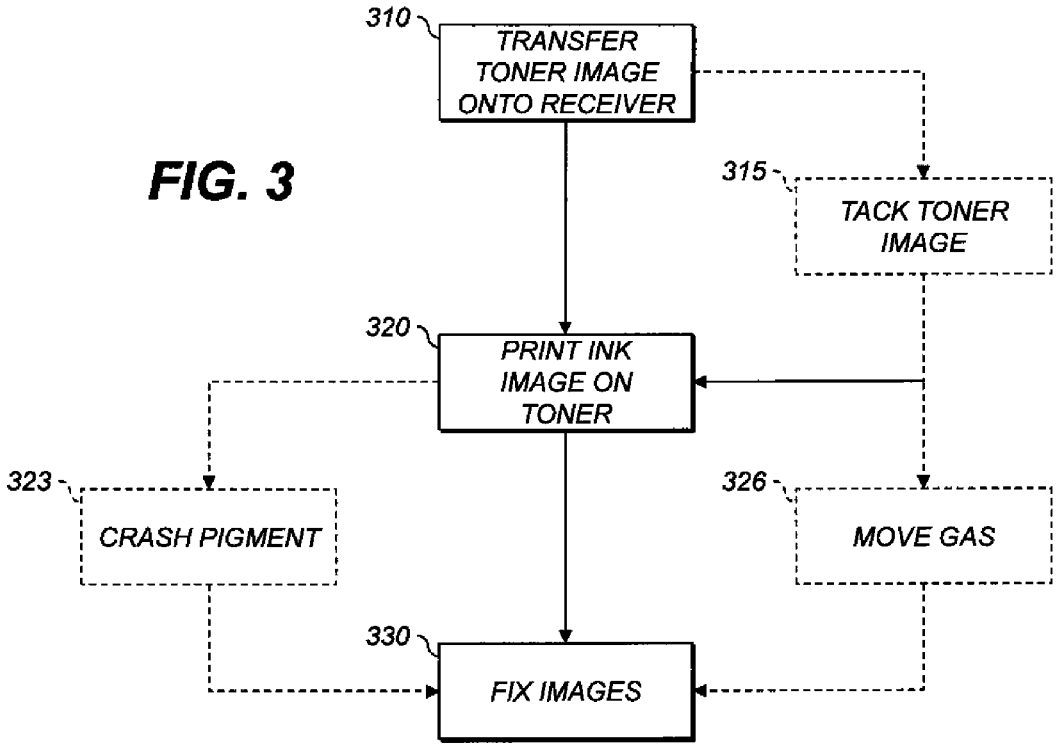
FIG. 3 shows methods of printing an image according to various embodiments.

FIG. 3 shows methods of printing an image according to various embodiments. Processing begins with step 310.

In step 310, a toner visible image is transferred onto a receiver to form a continuous or discontinuous toner image layer having a continuous or discontinuous visible surface. That is, colorant landing on the visible surface can be seen. The term "visible image" includes images using toners without colorant (clear toners). Toner can be transferred by electrostatic forces, as described above with respect to marking engine 32 (FIG. 1). Step 310 is followed by step 320 and optional step 315.

In optional step 315, the toner visible image is tacked to the receiver before printing the ink image. The toner can be heated above its glass transition temperature $T_g$ and held there without applying mechanical pressure to the toner. This permits the toner to flow so the particles can soften and sinter together. This results in a porous toner structure, i.e., in a matrix of connected toner particles that has holes throughout. The porous toner structure is less likely to be disrupted by the printing of the ink image onto the visible toner image than would be an untacked visible toner image. The tacked toner visible image does permit carrier fluid or solvent to pass through it and colorant to be retained. Step 315 is followed by step 320.

In step 320, an ink image is printed at least partially onto the toner visible image. This does not exclude the possibility of overspray or unintentional deposition of ink directly on the receiver. The ink includes a carrier fluid, e.g., water or various low carbon alcohols such as methanol, ethanol, isopropanol, propanol, butanol, isobutanol, and ethylene glycol, in which colorant can optionally be suspended or dissolved. The carrier fluid can be hydrophilic. Hydrophilic carrier fluids can be polar. For colorants suspended in the carrier fluid, the suspension can have a zeta potential, as measured using known techniques and commercially available equipment, greater than 60 mV of either sign potential. Conversely, a zeta potential of less than 30 mV is unstable and a zeta potential between 30 mV and 60 mV is semistable. A stable ink containing an aqueous carrier fluid or solvent and suspended pigment particles has a zeta potential whose magnitude is greater than 60 mV.

As discussed above with reference to FIGS. 2A and 2B, when the ink image is printed, at least a portion, e.g., 50%, of the carrier fluid passes through the toner image layer, and at least a portion, e.g., 50%, of the colorant is retained on or in the visible surface of the toner image layer. Step 320 is followed by step 330, and optionally steps 323 or 326.

In optional step 323, a pigment colorant suspended in the carrier fluid is caused to come out of suspension in the earner fluid ("crash") after printing the ink image and before fixing the toner visible image to the receiver, so that the pigment is deposited on the visible surface of, or within, the toner visible image. To do this, the zeta potential should be reduced to below 30 mV.

Zeta potentials can be reduced to below 30 mV by dissolving salts into the suspension (i.e., the pigment-containing ink). Such salts include water-soluble salts of alkali and alkali earth and halogens, nitrates, or nitrites such as sodium chloride, sodium fluoride, magnesium chloride, magnesium fluoride, potassium chloride, potassium nitrate, and sodium nitrate. Particles or thin films of these salts can be incorporated onto the surface of the toner particles deposited in step 310. Alternatively, if the toner has an open cell porous structure, salts can be incorporated within the open cells of the porous toner. Open-cell porous toner has larger surface area available to absorb colorant than do solid or closed-cell porous toners. The pigment is brought out of suspension in the carrier fluid before fixing the toner visible image to the receiver (step 330) so that the toner still has a large surface area to receive the pigment as it crashes. Step 323 is thus followed by step 330.

In optional step 326, a gas is moved across or through the toner image layer after printing the ink image, so that at least some of the carrier fluid evaporates in the gas. For example, air, nitrogen, argon, or dry air can be blown across or through the toner image layer after printing the ink image (step 320) so that at least some of the carrier fluid or solvent evaporates in the gas. In various embodiments, the gas is heated. Step 326 is followed by step 330.

In step 330, the toner visible image and the ink image are fixed to the receiver. This can be performed as described above with respect to fuser 60 (FIG. 1), or by subjecting the toner visible image and ink image to solvent vapors that cause the toner to flow and adhere to the receiver. Fixing can also include applying a selected level of gloss to the toner visible image and ink image.

Figure 4:
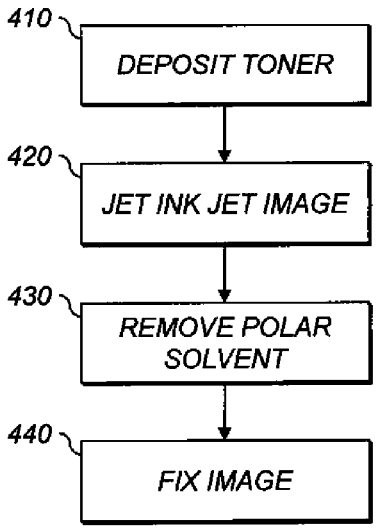
FIG. 4 shows a method of producing a deinkable inkjet print according to various embodiments.

FIG. 4 shows a method of producing a deinkable inkjet print according to various embodiments. Processing begins with step 410.

In step 410, colorant-absorbing toner particles are image-wise deposited on a water-absorbing receiver (e.g., uncoated or porous papers, including bond papers and calendared papers), to produce a colorant-absorbing particulate image. In various embodiments, the colorant-absorbing toner is colorless ("clear") and has an open-cell porous structure. Step 410 is followed by step 420.

In step 420, an inkjet image is jetted onto the receiver in register with the colorant-absorbing particulate image. The inkjet ink contains a polar solvent such as water or low-carbon-chain alcohols, i.e., alcohols containing four or fewer carbons such as methanol, ethanol, propanol, butanol, and ethylene glycol. Step 420 is followed by step 430.

In step 430, at least some of the polar solvent is removed from the colorant-absorbing particulate image. This separates the colorant from the hydrophilic liquid and entraps the colorant into a material that is soluble in a hydrophobic organic solvent. This can be accomplished by passing gas through the colorant-absorbing ink image, applying a vacuum to the non-image-bearing side of the receiver, or heating the ink using noncontact heating methods such as microwave, RF, IR, or radiant absorption. Alternatively, the non-image bearing surface of the receiver can be brought into contact with a hot surface such as a heater to evaporate the solvent. If the solvent is evaporated, the toner should not be permitted to fuse, but can be permitted to tack to create a porous toner mass, as described above. Step 430 is followed by step 440.

In step 440, the colorant-absorbing particulate image is fixed to the receiver, e.g., as discussed above with reference to fuser 60 (FIG. 1).

Toners useful with various embodiments include those with thermoplastic polymer binders such as polyester and polystyrene. The toners should not be thermoset materials, and should not cross-link or change from a thermoplastic to a thermoset, e.g., with exposure to UV radiation, heat, or time. Using non-thermoset toners provides increased solubility of toner in organic solvents commonly used for deinking printed papers. In various embodiments, the polymer binder has a glass transition temperature between 45° C. and 70° C., or between 50° C. and 58° C.

In various embodiments, the colorant-absorbing toner particles are stained by the colorant (the colorant can be a dye or a pigment). In an example, the colorant is a dye dissolved in the solvent of the ink, and the dye separates from the ink by staining the toner. The toner can be polyester, which can be readily stained by a wide variety of dyes. In various embodiments, the toner does not include polystyrene or polystyrene acrylate, since those materials can be stained by only a limited number of dyes having specific pH levels.

In various embodiments, the polar solvent is removed from the colorant-absorbing particulate image by absorption of the solvent by the receiver, followed by subsequent drying of the receiver. In these embodiments, the receiver can be a receiver that does not contain a clay coating or polymer coating on the surface. The receiver can be dried by conductive, convective, or radiative heating, by pressure, or by combinations of those.

Figure 5:
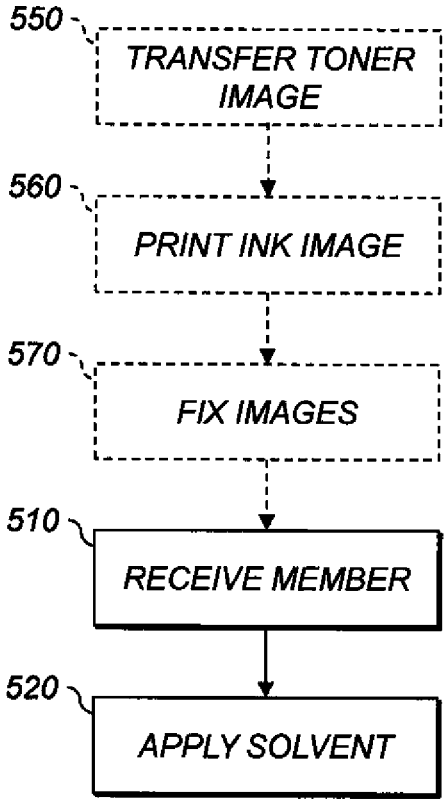
FIG. 5 shows a method of deinking an image-bearing member using an organic solvent according to various embodiments.

FIG. 5 shows a method of deinking an image-bearing member using an organic solvent according to various embodiments. Deinking begins with step 510, but optional substrate preparation begins with step 550. The organic solvent is hydrophobic or oliophilic.

In step 550, before the image-bearing member is received (step 510, below), a toner image is transferred onto the image-bearing member. The toner is soluble in the hydrophobic or oliophilic organic solvent. Step 550 is followed by step 560.

In step 560, an ink image corresponding to the toner image is printed onto the toner image on the receiver, so that the colorant is disposed over the toner image layer. This forms the continuous or discontinuous image layer. The ink includes colorant in a carrier fluid. Step 560 is followed by step 570.

In step 570, the toner visible image and the ink image are fixed to the receiver. This completes optional substrate preparation. Step 570 is followed by step 510.

In step 510, the first step of the deinking process, the image-bearing member is received. The image-bearing member has thereon a continuous or discontinuous image layer formed of toner particles that do not include colorant, and of colorant particles or molecules. These can be provided by steps 550-570, discussed above. The colorant particles or molecules are arranged in a pattern corresponding to the arrangement of the toner particles. The colorant is insoluble in the organic solvent. Step 510 is followed by step 520.

In step 520, the hydrophobic or oliophilic organic solvent is applied to the image-bearing member, so that a majority of the toner image layer is dissolved off the image-bearing member and the colorant is removed from the image-bearing member. As a result, a deinked reflection density of the image-bearing member in a selected test area from which the toner image layer was dissolved is within 0.15 of an unprinted reflection density of the image-bearing member before deinking. The imprinted reflection density is the average density of the paper without any colorant thereon.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
31, 32 electrophotographic (EP) marking engine
38 toner image
39 fused image
40 supply unit
42, 42A, 42B, 42C receiver
50 transfer subsystem
60 fuser
62 fusing roller
64 pressure roller
66 fusing nip
68 release fluid application substation
70 inkjet marking engine
71 ink manifold
72 heater
76 nozzle
77 ink drop
78 ink image
90 finisher
91 output tray
95 transport web
96 cleaning station
99 logic and control unit (LCU)
100 printer
220*a*, 220*h* water molecule
222 colorant particle
238*a*, 238*b*, 238*c* toner particle
248 addendum
310 transfer toner image onto receiver step
315 tack toner image step
320 print ink image on toner step
323 crash pigment step
326 move gas step
330 fix images step
410 deposit toner step
420 jet inkjet image step
430 remove polar solvent step
440 fix image step
510 receive member step
520 apply solvent step
550 transfer toner image step
560 print ink image step
570 fix images step

The invention claimed is:

1. A method of producing a deinkable print on an image-bearing member, comprising:

transferring a toner image having toner particles onto the image-bearing member to form a continuous toner image layer, wherein toner in the toner image is soluble in a hydrophobic or oliophilic organic solvent;

printing an ink image corresponding to the toner image onto the toner image, the ink including colorant in a hydrophilic carrier fluid, so that the colorant is disposed over the toner image layer; and fixing the toner image and ink image to the image-bearing member;

wherein the image-bearing member has an unprinted reflection density and has a deinked reflection density at most 0.15 above the unprinted reflection density, and after fixing the toner image and the ink image, the toner particles and ink are removable from the image-bearing member.

2. A method of producing a deinkable print on an image-bearing member, comprising:

transferring a toner image onto the image-bearing member to form a continuous or discontinuous toner image layer, wherein toner in the toner image is soluble in a hydrophobic or oliophilic organic solvent;

printing an ink image corresponding to the toner image onto the toner image on the image-bearing member, the ink including colorant in a hydrophilic carrier fluid, so that the colorant is disposed over the toner image layer;

fixing the toner image and ink image to the image-bearing member; and moving a gas across or through the toner image layer after printing the ink image, so that at least some of the carrier fluid evaporates in the gas;

wherein the image-bearing member has an unprinted reflection density and has a deinked reflection density at most 0.15 above the unprinted reflection density.

3. The method according to claim 2, wherein the colorant is insoluble in the hydrophobic or oliophilic organic solvent.

4. The method according to claim 2, further comprising tacking the toner image to the image-bearing member before printing the ink image.

5. The method according to claim 2, wherein the colorant is a pigment suspended in the carrier fluid, the method further comprising causing the pigment to come out of suspension in the carrier fluid after printing the ink image and before fixing the toner image to the image-bearing member, so that the pigment is deposited on a visible surface of, or within, the toner image layer.

* * * * *